US007785129B2

(12) United States Patent
Chen

(10) Patent No.: US 7,785,129 B2
(45) Date of Patent: Aug. 31, 2010

(54) RF CONNECTOR HAVING SEALING MEMBER

(75) Inventor: Jin-Ping Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,280

(22) Filed: Apr. 30, 2009

(65) Prior Publication Data

US 2009/0275226 A1 Nov. 5, 2009

(30) Foreign Application Priority Data

Apr. 30, 2008 (CN) ..... 2008 2 0035888

(51) Int. Cl.
*H01R 13/627* (2006.01)

(52) U.S. Cl. ..... 439/352; 439/271

(58) Field of Classification Search ..... 439/271, 439/578, 352, 675

See application file for complete search history.

(56) References Cited

U.S. PATENT DOCUMENTS 6,331,123 B1 * 12/2001 Rodrigues ..... 439/584
7,455,550 B1 * 11/2008 Sykes ..... 439/584
7,625,227 B1 * 12/2009 Henderson et al. ..... 439/350
2009/0280668 A1 * 11/2009 Rodrigues ..... 439/271

FOREIGN PATENT DOCUMENTS

WO WO2007/085099 8/2007

* cited by examiner

*Primary Examiner*—Neil Abrams
*Assistant Examiner*—Phuong Nguyen
(74) *Attorney, Agent, or Firm*—Ming Chieh Chang; Wei Te Chung; Andrew C. Cheng

(57) ABSTRACT

An RF connector (1) for mating with a plug connector (3) has an outer housing (1) defining an axial bore (101) for receiving the plug connector, a locking member (14) received in the axial bore, an insulative body (12) retained in the axial bore of the outer housing and defining an axial hole (121), a terminal (13) assembled to the axial hole of the insulative body, a first sealing ring (15) and a second sealing ring (16). The first sealing ring is assembled between an interior surface of the outer housing and an outer surface of the locking member. The second sealing ring is disposed around an inner surface of locking member for resisting against an outer surface of the plug connector when the plug connector is inserted in the RF connector.

14 Claims, 5 Drawing Sheets

RF CONNECTOR HAVING SEALING MEMBER

BACKGROUND OF THE INVENTION

1. Field of the Invention

The present invention relates to an RF (Radio Frequency) connector, and more particularly to an RF connector having sealing members.

2. Description of the Prior Art

WO Patent Publication 2007/085099 filed by Huber et al. discloses an RF cable connector assembly for transmitting RF signal and comprising an electrical connector and a plug connector. The electrical connector comprises an outer housing defining an axial hollow, a coupling member enclosed the outer housing, an insulative body retained in the axial bore, a terminal assembled to the axial hole of the insulative body for electrically mating with a pin of the plug connector, and a clamping sleeve located into the axial hollow of the outer shield. The clamping sleeve is adapted for exerting a force on an outer housing of the plug connector. The electrical connector further has a sealing ring disposed around an inner surface of the outer housing for resisting against the outer surface of the plug connector in order to seal off the intermediate space between the inner of clamping sleeve and the outer surface of the plug connector.

However, The sealing ring is not completely protected from undesirable influences from the outside because an intermediate space is formed between outer surface of the clamping sleeve and the outer housing.

Hence, an improved RF connector is needed to solve the above problem.

BRIEF SUMMARY OF THE INVENTION

Object of the present invention is to provide an RF connector for providing a reliable protection for the sealing of the RF connector.

The present invention provides an RF (Radio Frequency) connector for mating with a plug connector. The RF connector comprises an outer housing defining an axial bore for receiving the plug connector, a locking member received in the axial bore, an insulative body retained in the axial bore of the outer housing and defining an axial hole, a terminal assembled to the axial hole of the insulative body, a second sealing ring and a first sealing ring. The first sealing ring is assembled between an interior surface of the outer housing and an outer surface of the locking member. The second sealing ring is disposed around an inner surface of locking member for resisting against an outer surface of the plug connector when the plug connector is inserted in the RF connector.

The first sealing ring is provided for reliably sealing off an intermediate space between an interior surface of the outer housing and an outer surface of the locking member for protecting the terminal of RF connector from undesirable influences of the outside. The second sealing ring is provided for sealing off the intermediate space between the inner of locking member and the outer surface of the plug connector and together with the first ring for ensuring an electrical connection between the RF connector and the mating connecting.

Other objects, advantages and novel features of the invention will become more apparent from the following detailed description of the present embodiments when taken in conjunction with the accompanying drawings.

DETAILED DESCRIPTION OF THE INVENTION

Figure 1:
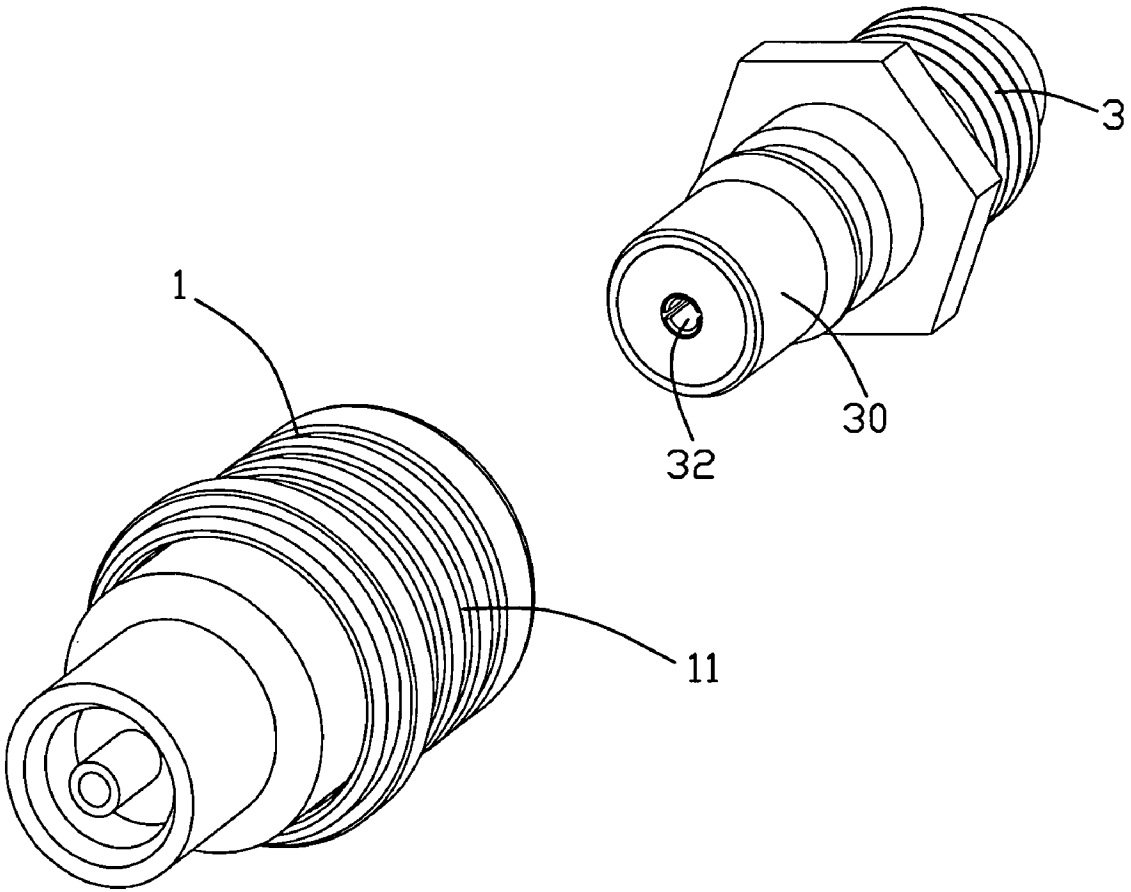
FIG. 1 is a perspective view of an RF connector in accordance with a first embodiment and a plug connector.
Figure 2:
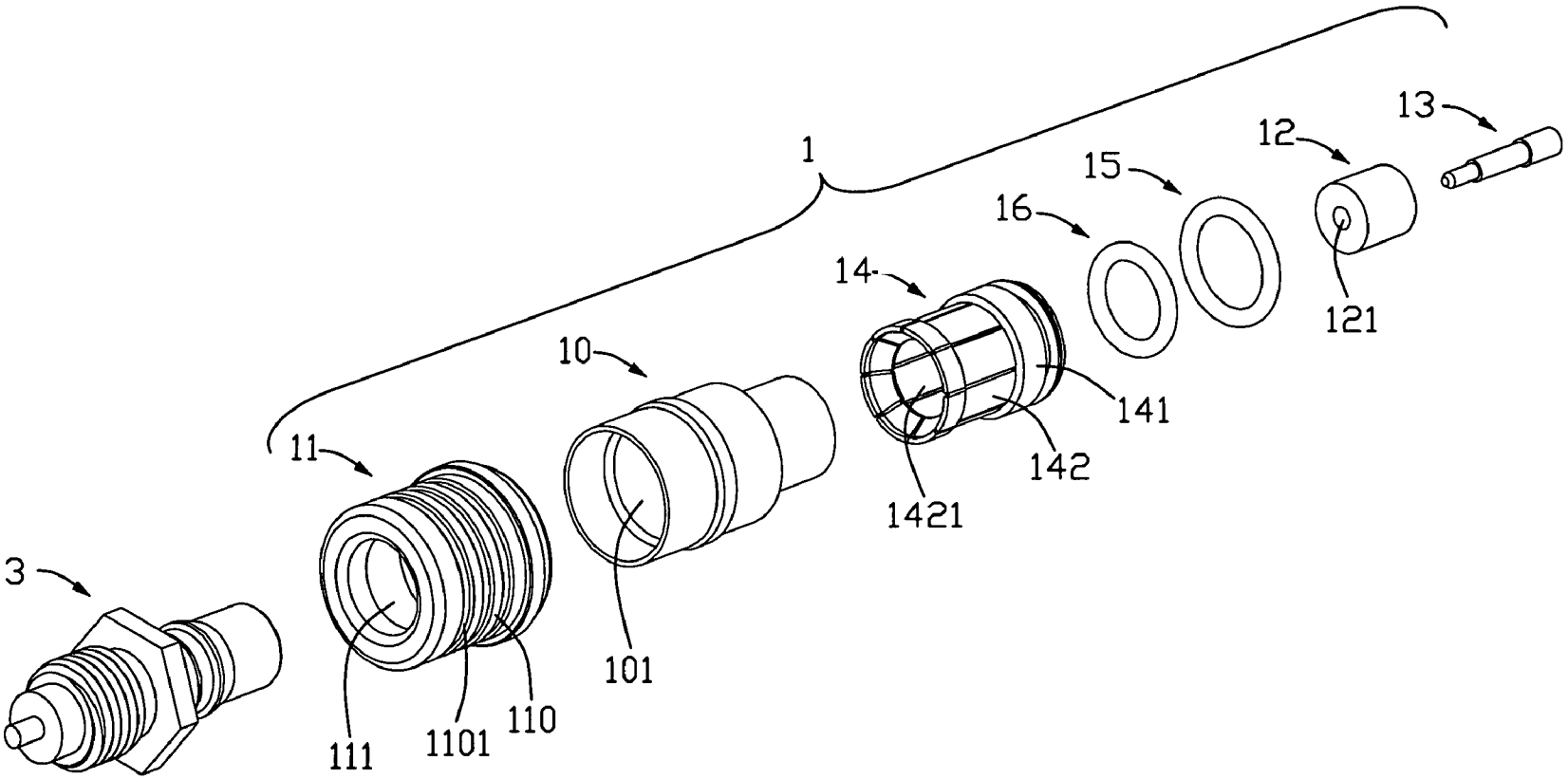
FIG. 2 is an exploded view of the RF connector and the plug connector as shown in FIG. 1.
Figure 3:
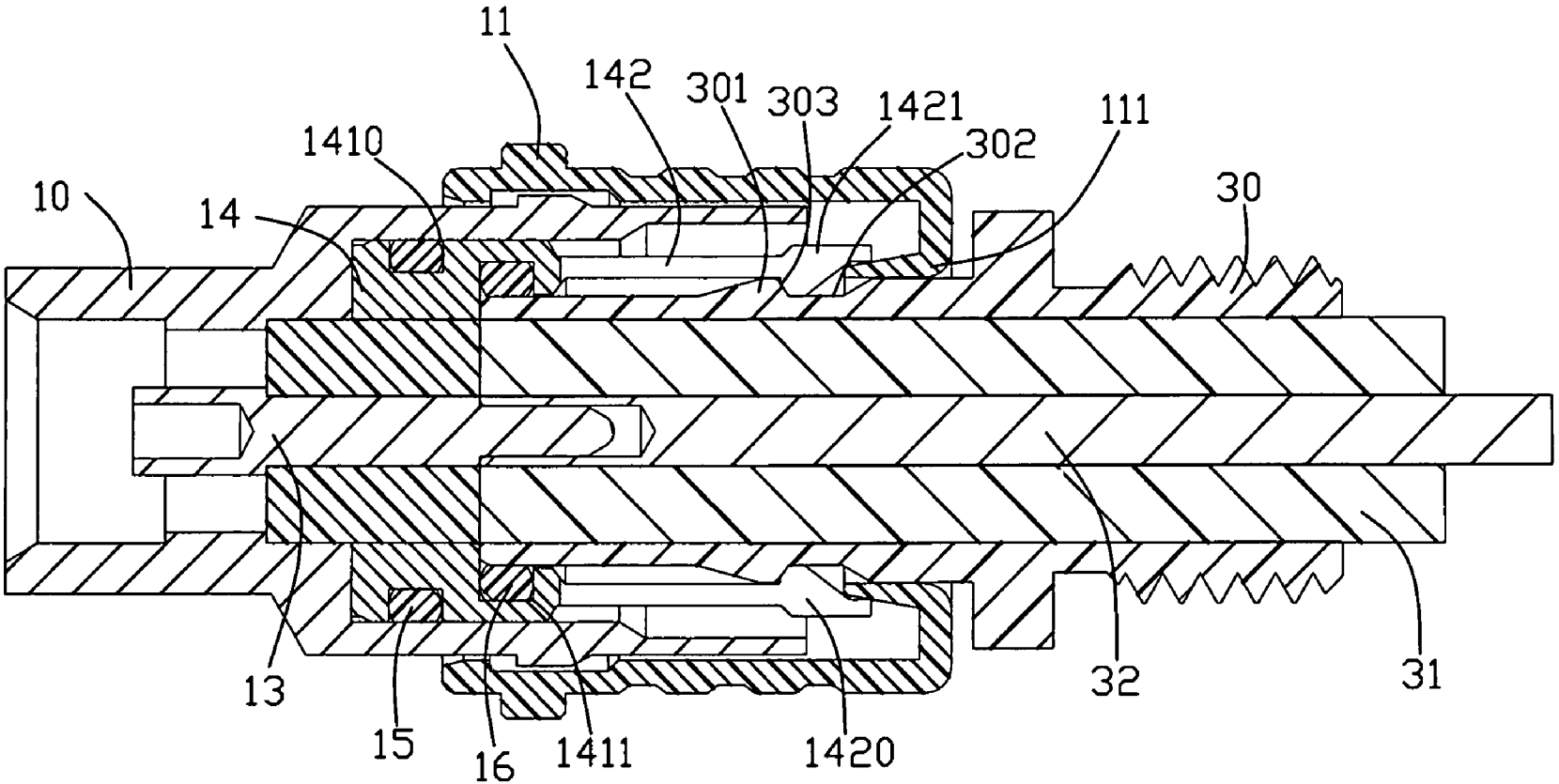
FIG. 3 is a cross-sectional view of the RF connector as shown in FIG. 1, taken along line 3-3, when the plug connector is inserted into an axial bore of the RF connector.

Reference will now be made to the drawing figures to describe the present invention in detail. Referring to FIGS. 1-3, an RF connector 1 is adapted for mating with a plug connector 3. The RF connector 1 comprises an outer housing 10 defining an axial bore 101 for receiving the plug connector 3, a locking member 14 received in the axial bore 101, an insulative body 12 retained in the axial bore 101 of the outer housing 10 and a terminal 13. The insulative body 12 defines an axial hole 121. The terminal 13 is assembled to the axial hole 121 of the insulative body 10.

The plug connector 3 has a cylindrical outer housing 30, an insulator 31 mounted into the outer housing 30 and a conductor 32 assembled to the insulator 31 for electrically connecting with the terminal 13 of the RF connector 1. The cylindrical outer housing 30 has a shoulder 301 protruding therefrom.

The RF connector 1 further has a first sealing ring 15 assembled between an interior surface of the outer housing 10 and an outer surface of the locking member 14, and a second sealing ring 16 disposed around an inner surface of locking member 14 for abutting against the outer housing 30 of the plug connector 3 when the RF connector 1 and the plug connector 3 are plugged together.

The first and the second sealing rings 15, 16 are made from rubber material in order to seal off undesirable influences from the outside. In other embodiment, the first and the second sealing rings could be made from other water-repellent material.

Referring to FIGS. 2-3, the locking member 14 is received in the axial bore 101 and has a base 141, a plurality of clamping beams 142 extending from the base 141 for clamping the plug connector 3 and a receiving room 1420 surrounded by the clamping beams 142 for receiving the plug connector 3. The base 141 of the locking member 14 has a first annular recess 1410 formed on an outer surface thereof for receiving the first sealing ring 15. The first sealing ring 15 is envelopped in the first annular recess 1410 and abuts against the interior surface of the outer housing 10. The base 141 of the locking member 14 has a second annular recess 1411 formed on an inner surface of the base 141 for receiving the second sealing ring 16 and rebusting against the outer surface of the outer housing 30 of the plug connector 3. The clamping beam 142 has a hook 1421 formed on end portion thereof and extending into the receiving room 1420 for locking with the shoulder 301 protruding from the outer surface of the plug connector 3.

The RF connector 1 comprises a coupling shell 11 partially enclosing the outer housing 10. The coupling shell 11 has an operating portion 110 and a latching portion 111 extending from the operating portion 110 and into the axial bore 101 of the insulative body 10 for moving the hook 1421 of the clamping beam 142 away from the shoulder 301 of the plug connector 3. The operating portion 110 of the coupling shell 11 has a plurality of circumferential ridges 1101 disposed around the outer face thereof.

During assembling, firstly, the terminal 13 is mounted into the insulative body 12. The insulative body 12 is received in the axial bore 101 of the outer housing 101. Secondly, the first sealing ring 15 and the second sealing ring 16 are respectively envelopped in the first and second annular recess 1410, 1411 of the locking member 14. Thirdly, the locking member 14 is mounted into the axial bore 101 of the outer housing 10. Finally, the outer shell 11 encloses the outer housing 10.

The first sealing ring 15 is provided for reliably sealing off an intermediate space between an interior surface of the outer housing 10 and an outer surface of the locking member 14 for protecting the terminal 13 of RF connector 1 from undesirable influences of the outside. The second sealing ring 16 is provided for sealing off the intermediate space between the inner of locking member 14 and the outer surface of the plug connector 3 and together with the first sealing ring 15 for ensuring an electrical connection between the RF connector 1 and the mating connecting 3.

Figure 4:
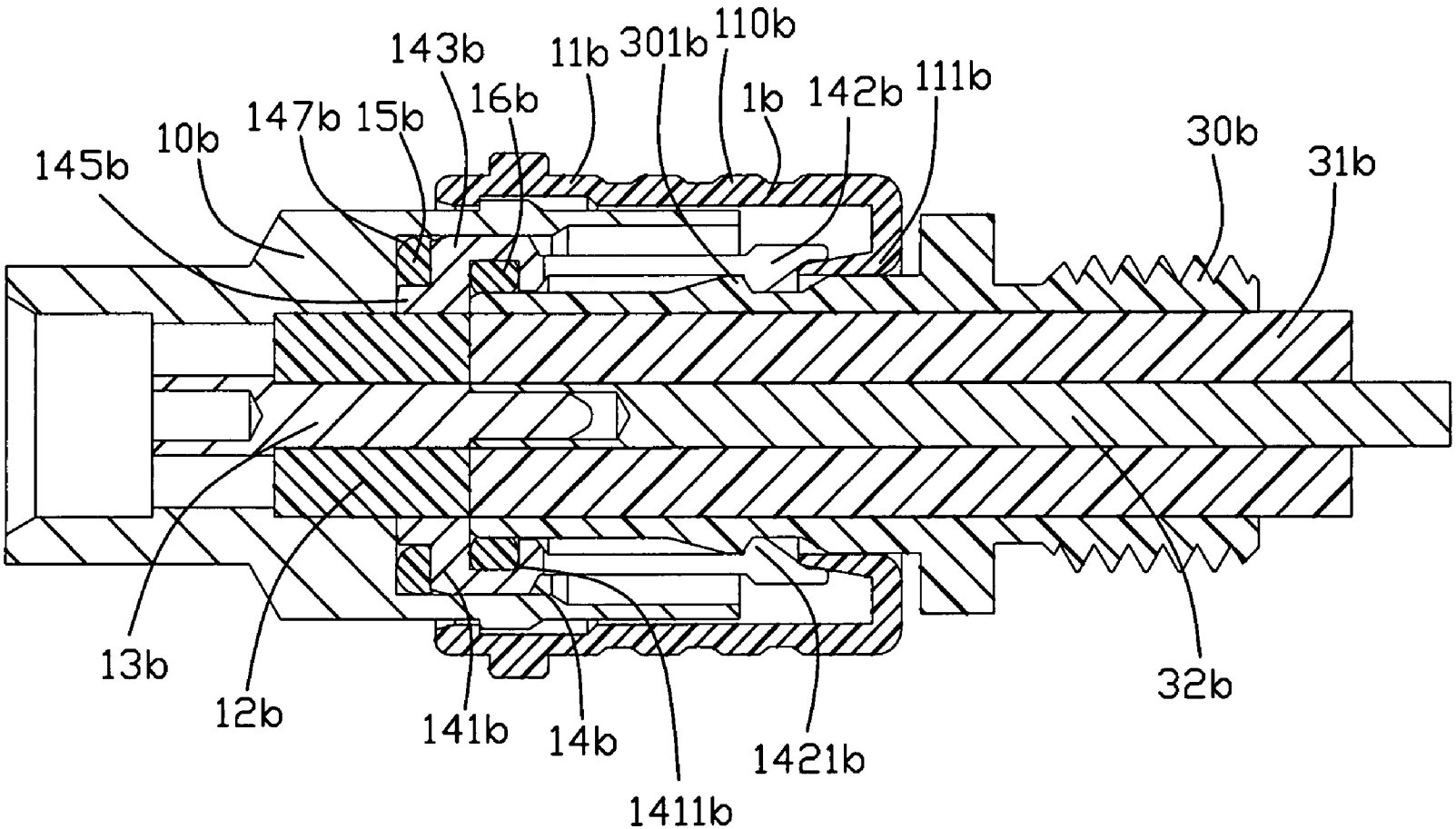
FIG. 4 is a cross-sectional view of the RF connector in accordance with a second embodiment, when the plug connector is inserted into an axial bore of the RF connector.

FIG. 4 illustrate a second preferred embodiment of the present invention. In this embodiment, an RF connector 1*b* is adapted for mating with a plug connector 3*b*. The RF connector 1*b* comprises an outer housing 10*b* defining an axial bore (not labeled) for receiving the plug connector 3*b*, a locking member 14*b* received in the axial bore, an insulative body 12*b* retained in the axial bore of the outer housing 10*b*, a terminal 13*b* assembled into insulative body 10*b*, and a coupling shell 11*b* partially enclosing the outer housing 10*b*.

The plug connector 3*b* has a cylindrical outer housing 30*b*, an insulator 31*b* mounted into the outer housing 30*b* and a conductor 32*b* assembled into the insulator 31*b* for electrically connecting with the terminal 13*b* of the RF connector 1*b*. The cylindrical outer housing 30*b* has a shoulder 301*b* protruding therefrom.

The locking member 14*b* is received in the axial bore and has a base 141*b*, a plurality of clamping beams 142*b* extending from the base 141*b* for clamping the plug connector 3*b*. The base 141*b* has a first stepped portion 143*b*, a second stepped portion 145*b* extending upwardly from the first stepped portion 143*b* for forming an indentation 147*b* for securing the first sealing ring 15*b*. The base 141*b* of the locking member 14*b* has a second annular recess 1411*b* formed on an inner surface of the base 141*b* for receiving the second sealing ring 16*b* and abutting against the outer surface of the outer housing 30*b* of the plug connector 3*b*. The clamping beam 142*b* has a hook 1421*b* formed on end portion thereof for locking with the shoulder 301*b* protruding from the outer surface of the plug connector 3*b*.

The RF connector 1*b* comprises a coupling shell 11*b* partially enclosing the outer housing 10 and has an operating portion 110 and a latching portion 111*b* extending from the operating portion 110*b* and into the axial bore of the insulative body 12*b* for moving the hook 1421*b* of the clamping beam 142*b* away from the shoulder 301*b* of the plug connector 3*b*.

During assembling, firstly, the terminal 13*b* is mounted into the insulative body 12*b*. The insulative body 12*b* is received in the axial bore 101*b* of the outer housing 101*b*. Secondly, the second sealing ring 16*b* is received in the second annular recess 1411*b* of the locking member 14*b* and the first sealing ring 15*b* is located in the indentation 147*b*. Thirdly, the locking member 14*b* is mounted into the axial bore 101*b* of the outer housing 10*b*. Finally, the outer shell 11*b* encloses the outer housing 10*b*.

Figure 5:
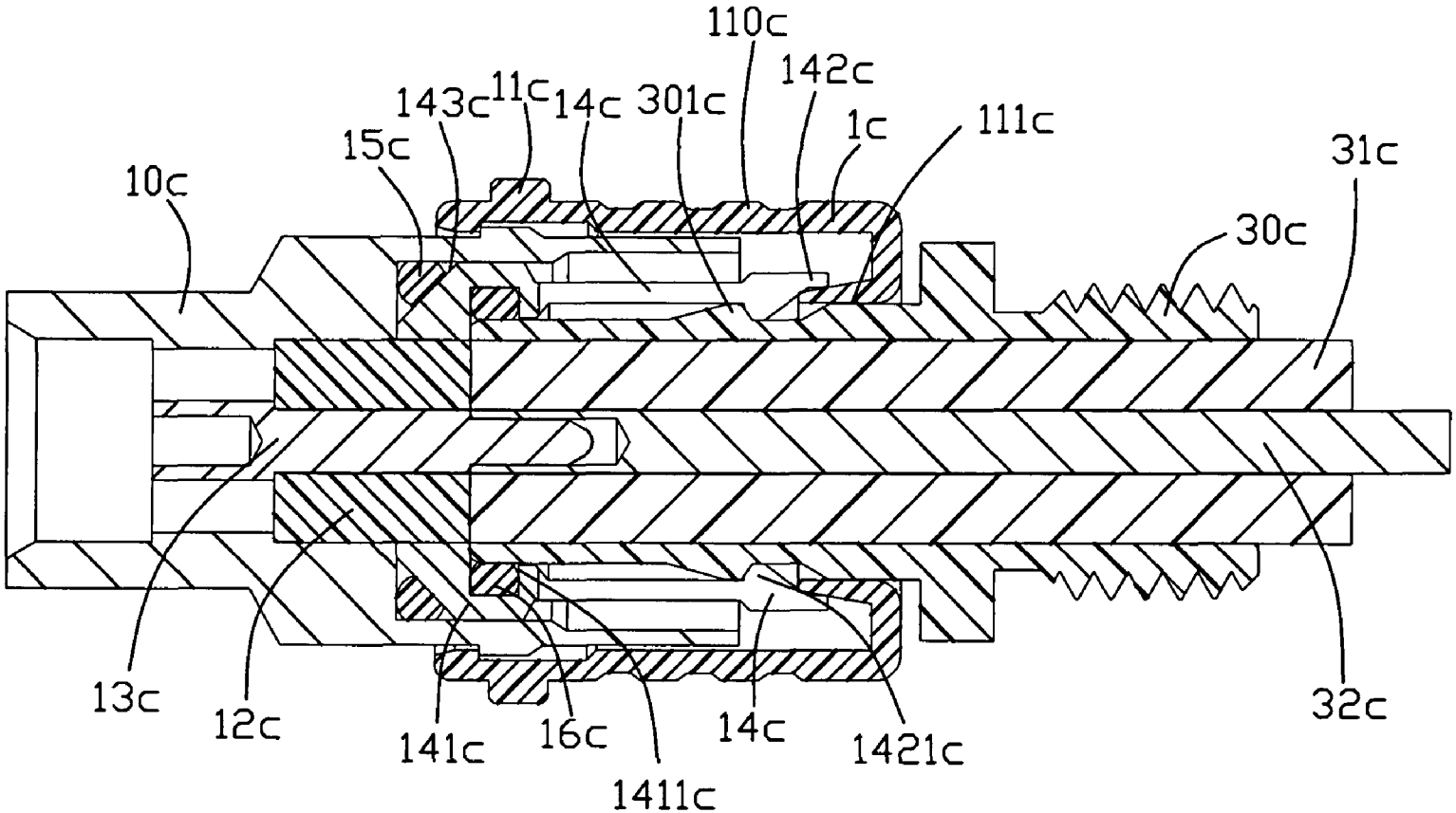
FIG. 5 is a cross-sectional view of the RF connector in accordance with a third embodiment, when the plug connector is inserted into an axial bore of the RF connector.

FIG. 5 illustrates a third preferred embodiment of the present invention. In this embodiment, an RF connector 1*c* is adapted for mating with a plug connector 3*c*. The RF connector 1*c* comprises an outer housing 10*c* defining an axial bore for receiving the plug connector 3*c*, a locking member 14*b* received in the axial bore, an insulative body 12*c* retained in the axial bore of the outer housing 10*c*, a terminal 13*c* assembled into insulative body 12*c*, and a coupling shell 11*c* partially enclosing the outer housing 10*c*.

The plug connector 3*c* has a cylindrical outer housing 30*c*, an insulator 31*c* mounted into the outer housing 30*c* and a conductor 32*c* assembled into the insulator 31*c* for electrically connecting with the terminal 13*c* of the RF connector 1*c*. The cylindrical outer housing 30*c* has a shoulder 301*c* protruding therefrom.

The outer housing 10*c* of the RF connector 1*c* has a configuration similar to that of the outer housing 10 referred in the first embodiment. Detailed description is not illustrated here.

The locking member 14*c* is received in the axial bore and has a base 141*c*, a plurality of clamping beams 142*c* extending from the base 141*c* for clamping the plug connector 3*c*. The base 141*c* has a slantwise surface 143*c* formed on a corner thereof, the first sealing ring 15*c* is sandwiched between the slantwise surface 143*c* and the interior surface of the outer housing 10*c*. The base 141*c* of the locking member 14*c* has a second annular recess 1411*c* formed on an inner surface of the base 141*c* for receiving the second sealing ring 16*c* and abutting against the outer surface of the outer housing 30*c* of the plug connector 3*c*. The clamping beam 142*c* has a hook 1421*c* formed on end portion thereof for locking with the shoulder 301*c* protruding from the outer surface of the plug connector 3*c*.

The RF connector 1*c* comprises a coupling shell 11*c* partially enclosing the outer housing 10*c* and has an operating portion 110*c* and a latching portion 111*c* extending from the operating portion 110*c* and into the axial bore 101*c* of the insulative body 12*c* for moving the hook 1421*c* of the clamping beam 142*c* away from the shoulder 301*c* of the plug connector 3*c*.

During assembling, firstly, the terminal 13*c* is mounted into the insulative body 12*c*. The insulative body 12*c* is received in the axial bore 101*c* of the outer housing 101*c*. Secondly, the first sealing ring 15*c* is received in the axial bore 101*c* of the outer housing 10*c*. The second (sealing ring 16*c* is envelopped in the second annular recess 1411*c* of the locking member 14*c*. Thirdly, the locking member 14*c* is mounted into the axial bore 101*c* of the outer housing 10*c*. Finally, the outer shell 11*c* encloses the outer housing 10*b*.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An RF (Radio Frequency) connector for mating with a plug connector, comprising:

an outer housing defining an axial bore for receiving the plug connector;

a locking member received in the axial bore;

an insulative body retained in the axial bore of the outer housing and defining an axial hole;

a terminal assembled to the axial hole of the insulative body;

a first sealing ring assembled between an interior surface of the outer housing and an outer surface of the locking member; and a second sealing ring disposed around an inner surface of the locking member for abutting against an outer surface of the plug connector when the plug connector is inserted in the RF connector;

said locking member has a base, a plurality of clamping beams extending from the base for clamping the plug connector and a receiving room surrounded by the clamping beams for receiving the plug connector;

said base of the locking member has a first annular recess formed on the outer surface thereof, and wherein the first sealing ring is disposed in the first annular recess and resists against the interior surface of the outer housing;

said clamping beam has a hook extending into the receiving room of the locking member for locking with a shoulder protruding from the outer surface of the plug connector;

a coupling shell partially enclosing the outer housing, and wherein the coupling shell has an operating portion and a latching portion extending from the operating portion into the axial bore of the outer housing for moving the hook of the clamping beam away from the shoulder of the plug connector.

2. The RF connector as claimed in claim 1, wherein said first and the second sealing rings are made from rubber material.

3. The RF connector as claimed in claim 1, wherein the second sealing ring defines four sides in a cross-sectional view, and three of said four sides are engaged within the locking member and the other one side is engaged with the second outer housing.

4. The RF connector as claimed in claim 3, wherein the first sealing ring defines four sides in a cross-sectional view, and three of said four sides are engaged within the locking member and the other one is engaged with the first outer housing.

5. The RF connector as claimed in claim 4, further comprising said first sealing ring is located behind the interface and both radially and axially farther from said interface than said second ring from said interface.

6. The RF connector as claimed in claim 3, wherein an insulator mounted into the outer housing of the plug connector and a conductor assembled to the insulator for electrically connecting with the terminal of the RF connector.

7. The RF connector as claimed in claim 6, wherein a cylindrical outer housing of the plug connector has a shoulder protruding thereform.

8. The RF connector as claimed in claim 6, wherein said base has a first stepped portion, a second stepped portion extending upwardly from the first stepped portion for forming an indentation to secure the first sealing ring.

9. The RF connector as claimed in claim 6, wherein said base has a slantwise surface formed on a corner thereof, and the first sealing ring is sandwiched between the slantwise surface and the interior surface of the outer housing.

10. An connector assembly comprising:

a RF connector including:

a first outer housing defining an axial bore for receiving the plug connector;

a metallic locking member received in the axial bore;

an insulative body having one section located in the axial bore of the outer housing and another section located in the locking member, said insulative body defining an axial hole;

a terminal assembled to the axial hole of the insulative body;

a plug connector including:

a front mating portion inserted into the locking member and including a second outer housing latchably engaged with the locking member;

said locking member has a base, a plurality of clamping beams extending from the base for clamping the plug connector and said clamping beam has a hook extending into a receiving room of the locking member for locking with a shoulder protruding from the outer surface of the plug connector; wherein a first sealing ring assembled is located between the outer housing and the locking member; and a second sealing ring is located between the locking member and the second outer surface of the plug connector;

the second sealing ring defines four sides in a cross-sectional view, and three of said four sides are engaged within the locking member and the other one side is engaged with the second outer housing;

a coupling shell partially enclosing the outer housing, and wherein the coupling shell has an operating portion and a latching portion extending from the operating portion into the axial bore of the outer housing for moving the hook of the clamping beam away from the shoulder of the plug connector.

11. The connector assembly as claimed in claim 10, wherein the RF connector is a receptacle connector.

12. The connector assembly as claimed in claim 10, wherein the first sealing ring defines four sides in a cross-sectional view, and three of said four sides are engaged within the locking member and the other one is engaged with the first outer housing.

13. The connector assembly as claimed in claim 10, wherein the second sealing ring is located intimately neighboring to an interface between the receptacle connector and the plug connector.

14. The connector assembly as claimed in claim 13, wherein said first sealing ring is located behind the interface and both radially and axially farther from said interface than said second ring from said interface.

* * * * *